US006279894B1

(12) United States Patent
Steinberg

(10) Patent No.: US 6,279,894 B1
(45) Date of Patent: Aug. 28, 2001

(54) DEVICE FOR SEPARATING STACKED FLAT BAG PIECES PROVIDED WITH SOCALLED SIDE FOLDS

(75) Inventor: Juergen Steinberg, Hoerstel (DE)

(73) Assignee: Windmöller & Hölscher, Lengerich (DE)

( * ) Notice: Subject to any disclaimer, the term of this patent is extended or adjusted under 35 U.S.C. 154(b) by 0 days.

(21) Appl. No.: 09/494,307

(22) Filed: Jan. 31, 2000

(30) Foreign Application Priority Data

Jan. 29, 1999 (DE) ..... 199 03 609
Feb. 6, 1999 (DE) ..... 199 05 328

(51) Int. Cl.[7] ..... B65H 5/08

(52) U.S. Cl. ..... 271/12; 271/11; 271/10.04; 271/95

(58) Field of Search ..... 271/94, 95, 99, 271/11, 12, 10.04, 276, 196

(56) References Cited

U.S. PATENT DOCUMENTS 3,720,409 * 3/1973 Kubo et al. ..... 271/95
4,542,894 * 9/1985 Feldkamper et al. ..... 271/95
5,080,341 * 1/1992 Lüthy ..... 271/12
5,169,285 * 12/1992 Müller ..... 271/12
5,174,559 * 12/1992 Diamantides ..... 271/12

FOREIGN PATENT DOCUMENTS

1202290 * 2/1965 (DE) ..... 271/95
0405107 * 1/1991 (EP) ..... 271/95

* cited by examiner

*Primary Examiner*—H. Grant Skaggs
(74) *Attorney, Agent, or Firm*—Jacobson Holman, PLLC

(57) ABSTRACT

Device for separating stacked flat bag pieces, comprising a supporting structure, which is pivot-mounted in a frame and is provided with a drive, and on which suction rollers can be rotated, whose drive is in a direction of rotation opposite to the supporting structure's direction of rotation. A stacking cassette is positioned in such a manner at the enveloping cylinder, described by the rows of suction elements or suction rollers that each row of suction elements in each roller pulls a bag piece from said cassette. To prevent the trailing side edges of the bag pieces from folding over, the bag pieces are held in the stacking cassette with offset cuts, facing outwardly in the direction of the axis of rotation. The stacking cassette and/or the suction elements are arranged in such a manner and/or the suction elements are controlled in such a manner that an outer suction element of each row of suction elements sucks in each bag piece at one end of the layer of the offset cut that overlaps the layer facing the suction element; and the other suction elements engage with the edge of bag piece, provided with a side fold, at an interval in time relative to the first suction element.

3 Claims, 4 Drawing Sheets

DEVICE FOR SEPARATING STACKED FLAT BAG PIECES PROVIDED WITH SOCALLED SIDE FOLDS

The invention relates to a device for separating stacked flat bag pieces provided with socalled side folds, comprising a supporting structure, which is pivot-mounted in a frame and is provided with a drive, and on which rollers, provided with a row of suction elements at equal angular distances, are mounted so as to rotate on a cylindrical enveloping surface, which is concentric with respect to the supporting structure's axis of rotation. The rollers' drivers are driven by way of intermediate wheels, mounted in the supporting structure, by a stationary central wheel, whose direction of rotation is opposite to the supporting structure's direction of rotation. The device also comprises a stacking cassette, which is positioned in such a manner at the enveloping cylinder, described by the row of suction elements, that each roller's row of suction elements pulls the first bag piece out of said cassette. Finally the device comprises a conveyor, which is positioned at the enveloping cylinder, accepts the individual workpieces and carries them away.

Socalled rotary feeders of this type are known, for example, from the DE-PS 12 77 655 and the DE 196 05 461 A1. These rotary feeders serve to separate flat workpieces, for example bag segments, which are inserted into a stacking cassette for the manufacture of bags or sacks. If bag pieces, intended for the manufacture of bags or sacks, are separated using rotary feeders, the stacks of bag segments are inserted into the stacking cassette at right angle, since the rotary feeders would have to exhibit much larger dimensions if the bag pieces were to be inserted into the stacking cassette lengthwise in the rotary feeder's direction of rotation. If flat lying bag pieces, exhibiting no side folds, are to be separated using a rotary feeder, there are no problems because the bag pieces can be pulled out of the stacking cassette cleanly and smoothly by means of rows of suction elements, which engage with the individual bag pieces in the area of a side edge. However, such a removal of perpendicularly inserted bag pieces, provided with side folds, is not possible because the rows of suction elements would engage only with one fold of the side edge and the other trailing side edge could bend or skew, thus preventing a clean, crumple-free removal.

Therefore, the object of the invention is to provide a device of the type described in the introductory part, with which stacks of bag segments, provided with side folds, can also be separated without the anxiety that the trailing side fold will fold over, skew or crease.

The invention solves this problem in that the stacking cassette holds bag pieces exhibiting cut edges, which face outwardly in the direction of the axis of rotation and are provided with socalled offset cuts and that the stacking cassettes and/or the suction elements are arranged in such a manner and/or the suction elements are controlled in such a manner that an outer suction element of each row of suction elements sucks in each bag piece at one end of the layer of the offset cut that overlaps the layer facing the suction element, and the other suction elements engage with the edge of each bag piece that is provided with a side fold at an interval in time relative to the first suction element.

It has been demonstrated surprisingly that with the device of the invention stacks of bag pieces, provided with side folds, can be separated flawlessly and the individual bag pieces can be fed to the next processing step. The flawless function of the device according to the invention is based presumably on the fact that because each bag segment to be pulled off is picked up first by an outer suction element at the end of an overlapping layer of an offset cut and is carried along, said bag segment to be pulled off experiences a certain convexity due to the circular motion of this suction element, a state that results in a stiffening of the edge region of the bag segment provided with side folds so that the trailing edge of the bag can no longer unfold when only the overlapped side fold is picked up in its edge region by the following suction element, thus after a time delay.

A preferred embodiment provides that the suction elements of each row lie on a line that together with the axis of rotation of the roller or roller disks carrying the suction elements encloses an acute angle and that the edges of the sides of the bag pieces to be pulled off are held parallel to this line in the stacking cassette. In this embodiment a first suction element of each row of suction elements is assigned in such a manner to one end of an overlapping layer of the offset cut of a bag piece, provided with side folds, that this end is picked up first and the next following suction elements of the row in turn engage with the edge of the bag piece, provided with a side fold. In this embodiment there is no need for the suction air stream of the suction elements to be controlled especially with respect to time.

The acute angle between the axis of rotation of the roller(s), carrying the suction elements, and the line of the suction elements ranges advantageously from approx. 4° to 12° and is preferably approximately 8°.

The invention will be explained in detail with reference to an embodiment shown in the drawings in which FIG. 1 is a schematic side view showing the rotary feeder of the invention that comprises a stacking cassette and a conveyor, which carries away the separated workpieces.

Figure 1:
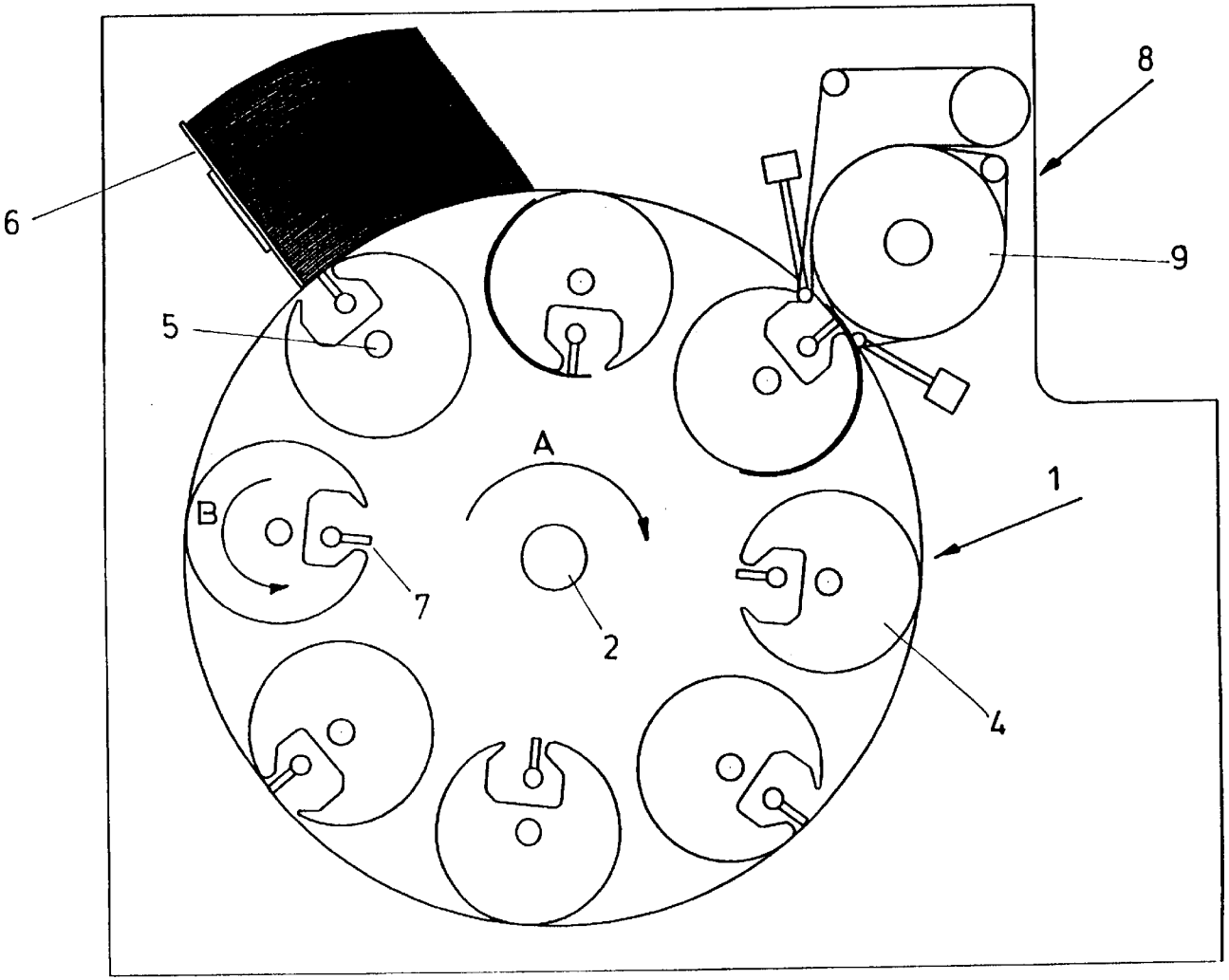
Figure 2:
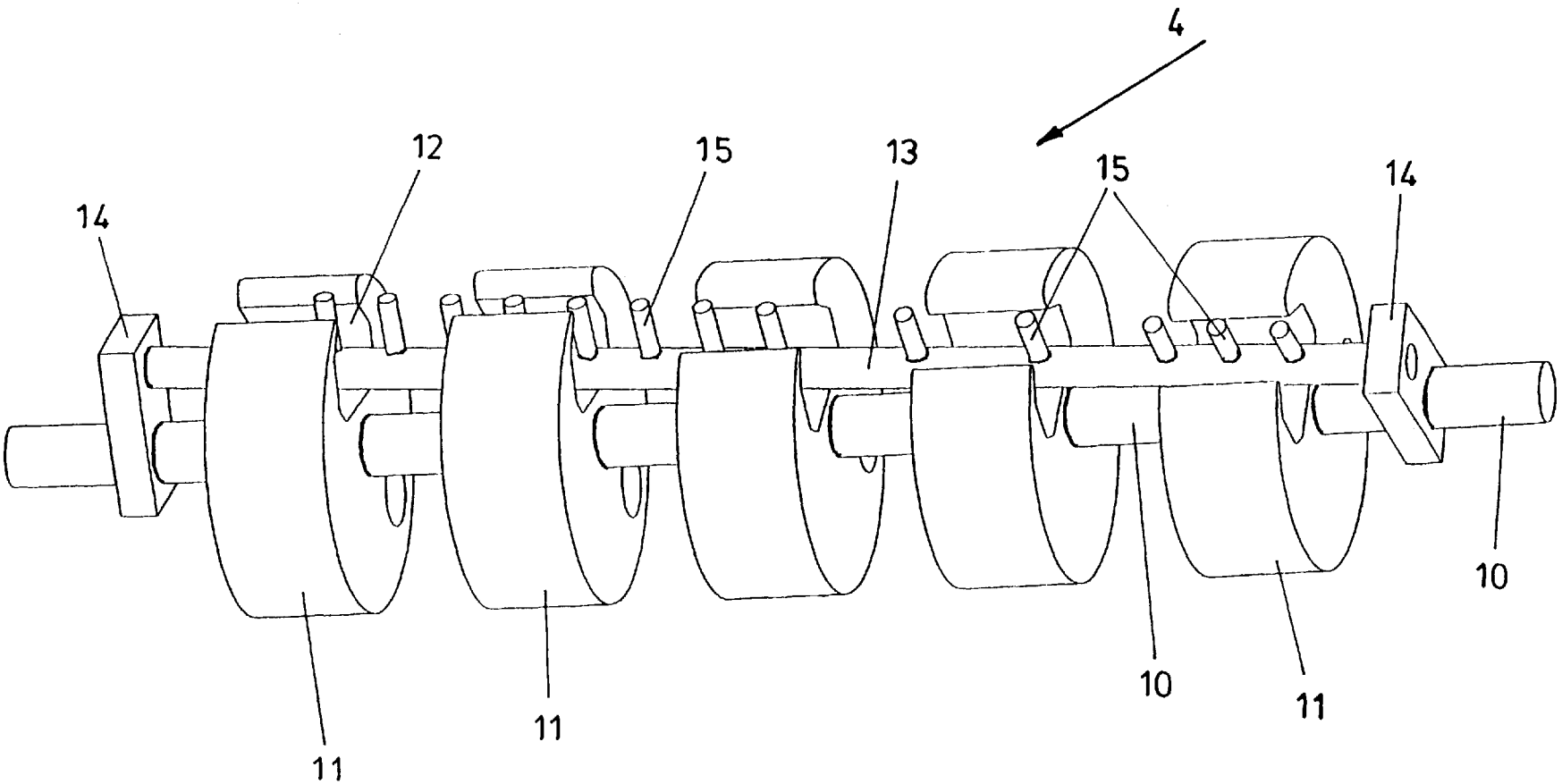
FIG. 2 is a perspective view showing a rotatable roller with a row of suction elements.

The rotary feeder 1, as shown in FIG. 1, comprises a supporting structure, which is pivot-mounted around the axis 2 in a machine frame (not illustrated) and is provided with a rotary drive (not illustrated) and on which the rollers or roller disks 4, which are provided with suction elements, are mounted so as to rotate. The shafts 5 of the suction rollers 4 are provided with gears (not illustrated), which are drive-connected by way of intermediate wheels (not illustrated) to a geared central wheel (not illustrated), which is mounted in the frame so as to be rotationally rigid and concentric relative to the supporting structure's axis of rotation 2. The frame is driven in the direction of the arrow A by a drive (not illustrated) so that the suction rollers rotate in the direction of arrow B.

The basic construction of the rotary feeder 1 matches that of the rotary feeders, disclosed in DE-PS 12 77 655 and DE 196 05 461 A1, to which reference will be made with respect to the rest of the design.

A stacking cassette 6 is mounted in such a manner above the rotary feeder in the machine frame that the individual rows 7 of suction elements of the suction cylinders 4 pull off the stacking cassette the bottommost bag piece from the stack of bag pieces held in said stacking cassette. Between the individual suction rollers 4 there are also the supporting rollers, supporting the stack and whose design is described, for example, in the DE-PS 12 77 655.

The separated bag pieces are transferred by a transfer conveyor 8 to a transporting conveyor (not illustrated). The transfer conveyor 8 comprises two continuous groups of belts, of which one group of belts runs over the rollers 9 and deflecting rollers, positioned at these rolls, and the other group runs in such a manner over deflecting rollers so as to form clamping carrying runs that run over the roll 9 and into whose inlet gap run the bag pieces, to be accepted from the suction rollers 4.

The individual suction rollers 4 comprise, according to a first embodiment, a hollow shaft 10, which is positioned in the rotary frame or supporting structure and which is connected to rotary lead-ins (not illustrated) with a suction air source. On the hollow shaft are fastened supporting disks 11, all of which form a suction roller. The supporting disks are provided with cut-outs 12, penetrated by a suction pipe 13. The suction pipe 13 is connected to the hollow shaft 10 by way of end-sided carrier brackets 14, whereby the carrier brackets 14 are provided with suction holes, which connect the hollow shaft 10 to the suction pipe 13. The suction pipe 13 is provided with radial suction connections or suction elements 15 in the illustrated manner. The suction pipe 13 is positioned at an angle relative to the hollow shaft 10 by appropriately rotating the carrier brackets 14 relative to each other, whereby the angle of tilt is approximately 8°. The length of the suction connections 15 is so long that their suction mouths lie on the enveloping surfaces, described by the cylindrical disks 10. Since the central region of the suction pipe 13 is closer to the hollow shaft 10 due to the tilt, the suction connections 15 in this region are correspondingly longer.

Figure 3:
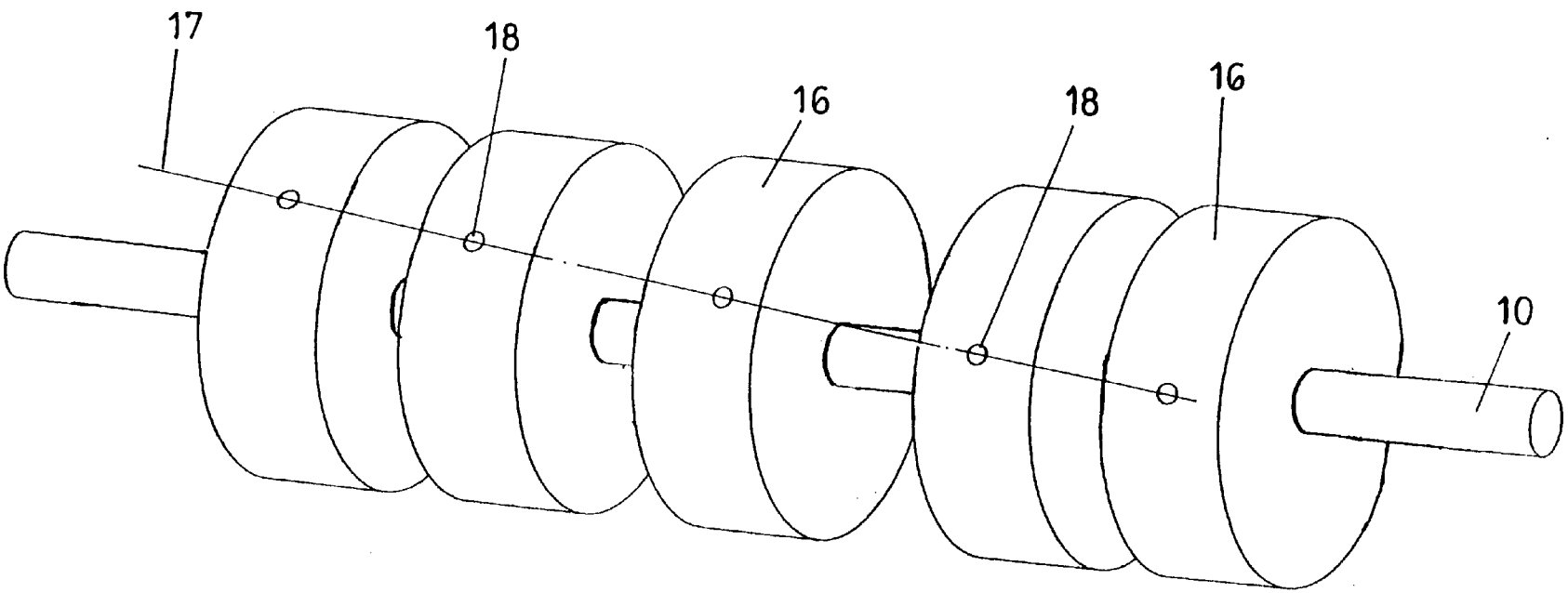
FIG. 3 is a view according to FIG. 2 of another design.

In the embodiment, according to FIG. 3, the hollow shaft 10 exhibits cylindrical disks 16, which are provided on a line 17 with suction boreholes 18, which are connected to the hole in the hollow shaft 10. The line 17 runs at an angle of also 8° relative to the axis of the hollow shaft 10.

Figure 4:
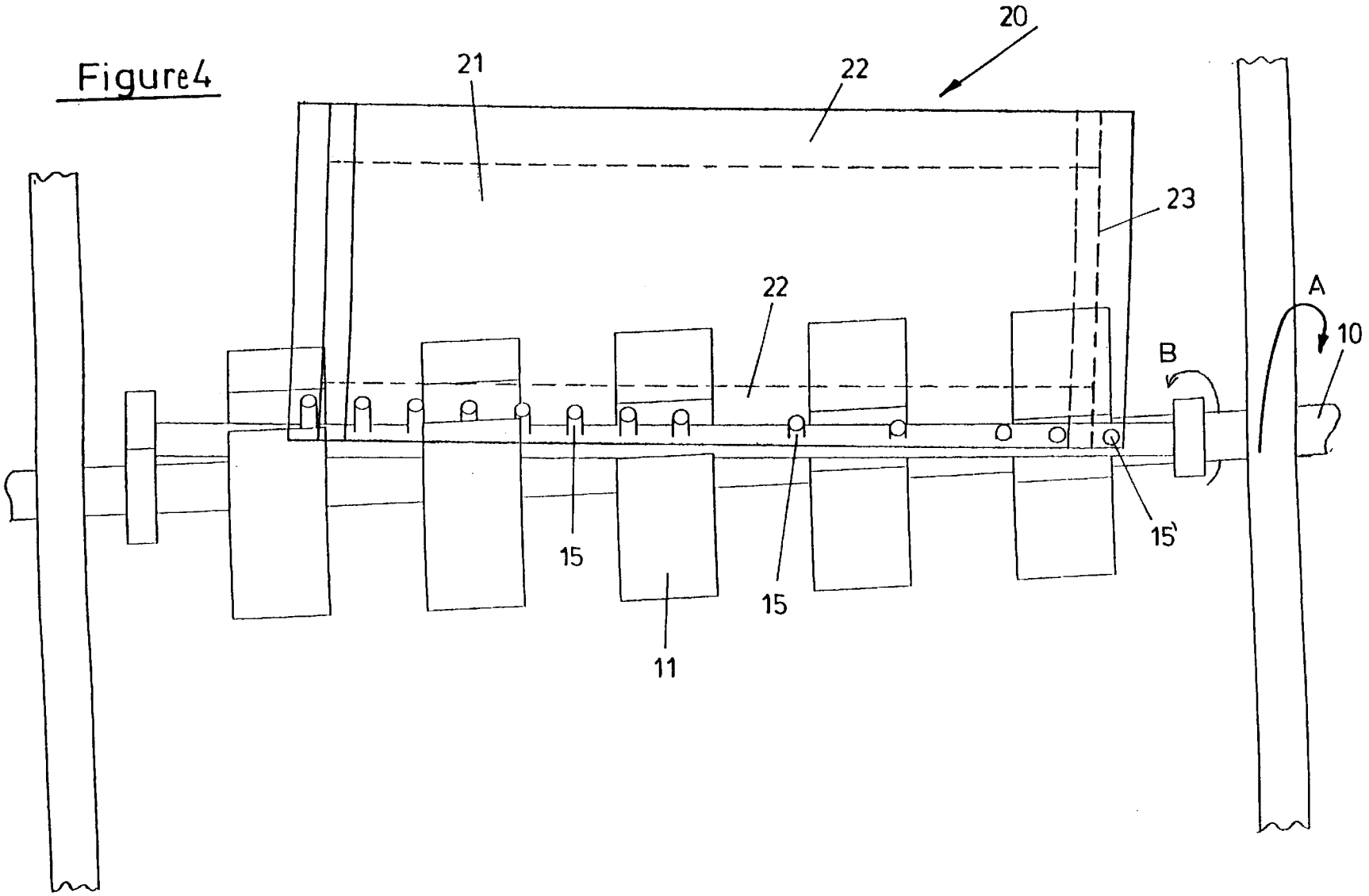
FIG. 4 is a top view showing the stacking cassette according to FIG. 1.

As evident from FIG. 4, the stacking cassette 20 is positioned at an angle of inclination of about 8° relative to the axis of the hollow shaft 10 so that the leading edges of the bag pieces 21, which are stacked in the stacking cassette 20 and exhibit side folds 22, run with their leading side edges approximately parallel to the rows of suction elements 15.

The first suction element 15' of each row of suction elements picks up the bottommost bag piece 21 at the end of the overlapping layer of the offset cut 23, as indicated in FIG. 4. For the method by which the suction element 15' picks up the bag piece at one end of the overlapping layer of the offset cut reference is made to DE 195 39 935 A1, which shows this method of suction for another apparatus.

What is claimed is:

1. Device for separating stacked flat bag pieces (21) provided with socalled side folds (22), comprising a supporting structure, which is pivot-mounted in a frame and is provided with a drive, and on which rollers (11, 16), provided with a row of suction elements (15, 18) at equal angular distances, are mounted so as to rotate on a cylindrical enveloping surface, which is concentric with respect to the supporting structure's axis of rotation, said rollers being driven in a direction of rotation opposite to the supporting structure's direction of rotation, comprising a stacking cassette (20), which is positioned in such a manner at the enveloping cylinder, described by the rows of suction elements (15, 19), that each roller's row of suction elements pulls the first bag piece (21) from the cassette, and comprising a conveyor (8), which is positioned at the enveloping cylinder, accepts the individual bag pieces and transports them away, characterized in that the stacking cassette (20) holds bag pieces (21) exhibiting cut edges, which face outwardly in the direction of the axis of rotation and are provided with socalled offset cuts (23) and that the stacking cassette (20) and/or the suction elements (15, 18) are arranged in such a manner and/or the suction elements are controlled in such a manner that an outer suction element (15') of each row of suction elements sucks in each bag piece (21) at one end of the layer of the offset cut that overlaps the layer facing the suction element; and the other suction elements (15, 18) engage with the edge of the bag piece (21) that is provided with a side fold at an interval in time relative to the first suction element (15').

2. Device, as claimed in claim 1, characterized in that the suction elements (15, 18) of each row lie on a line (17) that together with the axis of rotation of the rollers (11, 16), carrying said suction elements, encloses an acute angle and that the edges of the sides of the bag pieces (21) to be pulled off are held parallel to this line in the stacking cassette (20).

3. Device, as claimed in claim 2, characterized in that the acute angle ranges from about 4° to 12°.

* * * * *